US007198456B2

(12) United States Patent
Kollé et al.

(10) Patent No.: US 7,198,456 B2
(45) Date of Patent: Apr. 3, 2007

(54) FLOATING HEAD REACTION TURBINE ROTOR WITH IMPROVED JET QUALITY

(75) Inventors: Jack J. Kollé, Seattle, WA (US); Mark H. Marvin, Tacoma, WA (US)

(73) Assignee: Tempress Technologies, Inc., Kent, WA (US)

( * ) Notice: Subject to any disclaimer, the term of this patent is extended or adjusted under 35 U.S.C. 154(b) by 0 days.

(21) Appl. No.: 11/321,653

(22) Filed: Dec. 29, 2005

(65) Prior Publication Data

US 2006/0124362 A1 Jun. 15, 2006

Related U.S. Application Data

(63) Continuation-in-part of application No. 10/990,757, filed on Nov. 17, 2004.

(60) Provisional application No. 60/640,742, filed on Dec. 30, 2004.

(51) Int. Cl.
*B05B 3/06* (2006.01)

(52) U.S. Cl. ..... 415/82; 239/246; 239/249; 239/252

(58) Field of Classification Search ..... 415/80, 415/82, 104; 239/246, 249, 252, 263, 275.1, 239/381

See application file for complete search history.

(56) References Cited

U.S. PATENT DOCUMENTS 2,855,671 A * 10/1958 Lundgren et al. ..... 433/106
2,963,099 A 12/1960 Gianelloni, Jr. ..... 175/25
3,054,595 A 9/1962 Kaufmann ..... 415/107
3,058,510 A 10/1962 Tiraspolsky et al. ..... 415/107
3,433,489 A 3/1969 Wiese ..... 277/401

(Continued)

FOREIGN PATENT DOCUMENTS

DE 1568680 6/1980
RU 587240 6/1980

OTHER PUBLICATIONS

Kollé, Jack K., "Moving an Ice Mountain." Mechanical Engineering, Feb. 1990, pp. 49-53.

(Continued)

*Primary Examiner*—Edward K. Look
*Assistant Examiner*—Nathan Wiehe
(74) *Attorney, Agent, or Firm*—Ronald M. Anderson

(57) ABSTRACT

A rotary jetting tool including a pressure-balanced rotor, which is achieved using a vented volume. Axial movement of the rotor relative to the housing caused by pressure imbalances acting on the rotor selectively uncovers or opens a vent that places the volume in fluid communication with an ambient volume, enabling the rotor to achieve a pressure balanced condition. A plurality of radial clearance seals between the rotor and the housing are used to provide hydrodynamic bearings to reduce friction between the rotor and housing. The diameters of the seals are manipulated to facilitate pressure balancing of the rotor. In one embodiment, the rotor includes a centrifugal brake configured to control a maximum rotational speed of the rotor. Pressurized fluid is introduced into the rotor in an axial direction, enabling a relatively large upstream settling chamber to be incorporated into the rotor, thereby reducing inlet turbulence and improving jet quality.

29 Claims, 4 Drawing Sheets

U.S. PATENT DOCUMENTS

| | | | | |
|---|---|---|---|---|
| 3,802,515 | A | 4/1974 | Flamand et al. | 173/176 |
| 3,810,637 | A | 5/1974 | Bonvin | 277/406 |
| 4,114,703 | A | 9/1978 | Matson, Jr. et al. | 175/107 |
| 4,196,911 | A | 4/1980 | Matsushita | 277/401 |
| 4,225,000 | A | 9/1980 | Mauer | 175/107 |
| 4,246,976 | A | 1/1981 | McDonald, Jr. | 175/107 |
| 4,324,299 | A | 4/1982 | Nagel | 175/107 |
| 4,437,525 | A | 3/1984 | O'Hanlon et al. | 175/218 |
| 4,440,242 | A | 4/1984 | Schmidt et al. | 175/107 |
| 4,493,381 | A | 1/1985 | Kajikawa et al. | 175/107 |
| 4,521,167 | A | 6/1985 | Cavalleri et al. | 418/82 |
| 4,529,046 | A | 7/1985 | Schmidt et al. | 175/107 |
| 4,665,997 | A | 5/1987 | Maurer et al. | 175/107 |
| 4,715,538 | A | 12/1987 | Lingnau | 239/248 |
| 4,747,544 | A | 5/1988 | Kranzle | 239/251 |
| 4,821,961 | A | 4/1989 | Shook | 239/253 |
| 4,905,775 | A | 3/1990 | Warren et al. | 175/45 |
| 4,923,120 | A * | 5/1990 | Hammelmann | 239/252 |
| 4,934,254 | A | 6/1990 | Clark et al. | 277/406 |
| 5,028,004 | A * | 7/1991 | Hammelmann | 239/120 |
| 5,603,385 | A | 2/1997 | Colebrook | 175/45 |
| 5,685,487 | A | 11/1997 | Ellis | 239/261 |
| 5,909,848 | A | 6/1999 | Zink | 239/252 |
| 5,909,879 | A | 6/1999 | Simpson | 277/399 |
| 5,938,206 | A | 8/1999 | Klosterman et al. | 277/399 |
| 6,027,040 | A * | 2/2000 | Frye-Hammelmann | 239/252 |
| 6,062,311 | A | 5/2000 | Johnson et al. | 166/312 |
| 6,263,969 | B1 | 7/2001 | Stoesz et al. | 166/334.4 |
| 6,347,675 | B1 | 2/2002 | Kollé | 175/69 |
| 6,453,996 | B1 * | 9/2002 | Carmichael et al. | 166/177.3 |
| 6,557,856 | B1 | 5/2003 | Azibert et al. | 277/401 |
| 2005/0109541 | A1 * | 5/2005 | Marvin et al. | 175/67 |

OTHER PUBLICATIONS

Kollé, Jack K., "A Comparison of Water Jet, Abrasive Jet and Rotary Diamond Drilling in Hard Rock." Presentation for Energy Sources Technology Conference & Exhibition (ETCE '98), Houston, Texas: Feb. 2-4, 1998, 6pp.

* cited by examiner

SECTION A-A

SECTION B-B

SECTION A-A

SECTION B-B

FLOATING HEAD REACTION TURBINE ROTOR WITH IMPROVED JET QUALITY

RELATED APPLICATIONS

This application is based on a prior now abandoned provisional application, Ser. No. 60/640,742, filed on Dec. 30, 2004, the benefit of the filing date of which is hereby claimed under 35 U.S.C. § 119(e). This application is also a continuation in part application based on a prior copending conventional application Ser. No. 10/990,757, filed on Nov. 17, 2004, the benefit of the filing date of which is hereby claimed under 35 U.S.C. § 120.

BACKGROUND

Rotary jetting tools are commonly used to clean scale or other deposits from oil and gas production tubing. These tools may also be used to drill soil and rock formations. In submerged applications such as deep well service, the effective jet range is severely limited by turbulent dissipation. The jets must be located at a large angle from the axis of rotation to minimize the standoff distance between the jet and the formation. Multiple jets are required to ensure that all of the formation ahead of the tool is swept by the reduced range of the submerged jets. An over-center jet must be placed so that its axis is directed across the rotary axis of the tool. Jet quality is also important, especially in harder formations. Large upstream settling chambers and tapered inlet nozzles improve jet quality by reducing inlet turbulence. It is desirable to make the rotary jetting tool as short and compact as possible to enable the tools to pass though tight radius bends in tubing, or to pass through a short radius lateral exit window from a well. In these applications, the tool may be mounted on a flexible hose. Finally, there is a need to provide a speed governor on the tools to prevent runaway. Unfortunately, the design requirement for compactness is in conflict with the other above-identified design requirements.

Rotating jetting tools may use an external motor to provide rotation, or the rotor can be self-rotating. A self-rotating system greatly simplifies the tool operation and reduces the tool size. In a typical self-rotating system, the jets are discharged with a tangential component of motion, which provides the torque necessary to turn the rotor. Most self-rotating systems use a sliding seal and support bearing to allow rotation of the working head. A drawback associated with this configuration is that the torque produced by the working jets must be sufficiently great to overcome static bearing and seal friction. The dynamic friction of bearings and seals is typically lower than the static friction, so the rotors can spin at excessive speeds, which can cause overheating or bearing failure. Most self-rotating jetting systems also incorporate a thrust bearing. Such bearings are subject to high loads and failure when the rotary speed is too great.

Hydrodynamic journal bearings rely upon a thin film of fluid that supports the rotating shaft through hydrodynamic forces. Journal bearings cannot support high thrust or radial loads, but are effective at high velocity—where the hydrodynamic lift is greatest. The thrust load can be eliminated with a balanced, or floating, rotor design. The rotor shaft is supported by opposed radial clearance seals, which also act as hydrodynamic journal bearings. If the shaft diameter is the same on both ends of the rotor, there is no thrust due to internal pressure of the fluid. This approach has been used by Schmidt (U.S. Pat. No. 4,440,242) and Ellis (U.S. Pat. No. 5,685,487) to provide a self-rotating jet. In both patents, the working fluid is introduced from the tangential surface of the rotor shaft to the center of the rotor by crossing ports. The drawback to this configuration is that the fluid settling chamber is small compared with the sealing diameter of the rotor. Also, the jet forming nozzles must be drilled from outside the rotor and do not produce a good quality jet. Finally, the jets discharge at a relatively small exit radius and small angle from the tool axis so the standoff to the gauge of the tool is relatively large. In the Schmidt patent, a separate rotor head that extends well beyond the thrust-balanced section is provided. The rotor head can be made relatively large to accommodate the desired jet pattern, but this approach defeats the requirement for a compact tool.

The rotational speed of a radial bearing rotor may be too high for effective jet erosion drilling of rock. A speed governing mechanism would substantially improve the jetting performance. Mechanisms incorporating mechanical, viscous, and magnetic brakes have been used to govern jet rotor speed. These mechanisms are typically relatively long and complex. It would therefore be desirable to incorporate a simple, compact speed governor in the rotor.

An important application for jet drilling rotors involves drilling short radius holes. The jet rotor required for such an application must be as short as possible to enable the tool to negotiate tight comers and short radius bends. Thus, it would be desirable to provide a compact jet rotor with multiple jets in orientations that: (1) generate sufficient torque to reliably start the rotor; (2) ensure efficient drilling; and, (3) eliminate side forces on the radial bearing that can cause wear. It would further be desirable to provide a compact jet rotor incorporating relatively large internal flow passages within the jet rotor, to minimize upstream turbulence and pressure losses, in order to provide the best possible jet performance. It would be still further desirable to provide a compact jet rotor incorporating an integral and compact speed governing brake. Finally, it would be desirable to provide a compact jet rotor incorporating wear-resistant materials in the design with sufficient precision to enable reliable manufacture and performance.

SUMMARY

An exemplary rotary jetting tool including a pressure balanced rotor, disclosed in detail herein, is achieved by incorporating a pressure balance volume, which is defined by a rotor and a housing. The rotor is configured to rotate relative to the housing, as well as to move axially relative to the housing. The rotor includes at least one nozzle at a distal end configured to discharge a pressurized fluid, thereby imparting a rotational force to the rotor. The rotary jetting tool is configured to be attached to a distal end of a drill string or a flexible tube (e.g., a coiled tube) configured to deliver a pressurized fluid from a source of the pressurized fluid. As pressurized fluid is introduced into the tool, a portion of the pressurized fluid is discharged from the at least one nozzle, thereby causing the rotor to begin to rotate, as well as causing the rotor to move axially with respect to the housing, in a direction generally opposite the direction in which the fluid jet is discharged from the at least one nozzle. This initial axial motion of the rotor reduces a size of the pressure balance volume. A portion of the pressurized fluid is also introduced into the pressure balance volume. Preferably, the rotary jetting tool includes a plurality of radial clearance seals, and the pressurized fluid is introduced into the pressure balance volume by fluid leaking past at least one of these radial clearance seals. As the pressure balance volume fills with the pressurized fluid, an axial motion will be imparted upon the rotor (now in an opposite direction as compared with the axial motion imparted by the fluid jet discharged by the at least one nozzle), thereby causing the size of the pressure balance volume to increase. The rotary jetting tool includes a vent that selectively places the pressure balance volume in fluid communication with an ambient volume, depending upon the axial position of the rotor. As the size of the pressure balance volume increases, the axial motion of the rotor opens the vent, thereby placing the pressure balance volume in fluid communication with the ambient volume. Thus, additional fluid introduced into the pressure balance volume will be vented through the vent, and no additional axial motion will be imparted to the rotor.

At this point, the rotor is pressure balanced, a "downward" pressure on the rotor being exerted by the pressurized fluid in the pressure balance volume substantially offsetting an "upward" pressure on the rotor being exerted by the jet of pressurized fluid being discharged by the at least one nozzle. (The terms "downward" and "upward" as used throughout this disclosure are in reference to directions shown in the accompanying Figures, and are not to be construed as absolute directions or in any way limiting to the application of this technology.) As will be described in greater detail below, the relative diameters of the radial clearance seals can be manipulated to facilitate achievement of the above noted pressure balanced condition.

Preferably, the pressurized fluid is introduced into the rotor via an inlet at the proximal end of the rotor, such that as the pressurized fluid enters the rotor, the pressurized fluid is moving coaxially relative to the rotor (based on an axis of the rotor passing through both the distal end and the proximal end of the rotor). This flow can thus be considered an axial flow. Such an axial flow configuration enables the tool to be relatively compact. Furthermore, this configuration enables a relatively larger settling volume to be incorporated into the rotor, compared to settling volumes that are incorporated into tools that do not exhibit such an axial flow configuration. Relatively larger settling volumes improve jet quality by reducing inlet turbulence.

In at least one exemplary embodiment, a second pressure balance volume is disposed proximate the distal end of the rotor, and in such an embodiment, the tool is configured such that when the axial position of the rotor places the pressure balance volume in fluid communication with the ambient volume, the "downward" pressure on the rotor being exerted by the pressurized fluid in the pressure balance volume substantially offsets the "upward" pressure on the rotor being exerted by both the jet of pressurized fluid being discharged by the at least one nozzle, and the "upward" pressure on the rotor being exerted by the pressurized fluid in the second pressure balance volume.

Another embodiment of a rotary jetting tool disclosed herein includes a centrifugal brake configured to limit a maximum rotational speed of the rotor. The centrifugal brake is disposed between the proximal and distal ends of the rotor, enabling a compact rotary jetting tool to be achieved. The centrifugal brake can be implemented by forming pockets in the rotor to accommodate braking masses, which will frictionally engage the housing in response to increasing rotational speed of the rotor. In one embodiment, a distal portion of the housing is tapered, and a tapered cartridge engages the tapered portion of the housing, such that the braking masses frictionally engage the tapered cartridge. Preferably, the braking masses and the tapered cartridge are implemented using ultra-hard and abrasion-resistant materials.

This Summary has been provided to introduce a few concepts in a simplified form that are further described in detail below in the Description. However, this Summary is not intended to identify key or essential features of the claimed subject matter, nor is it intended to be used as an aid in determining the scope of the claimed subject matter.

DRAWINGS

Various aspects and attendant advantages of one or more exemplary embodiments and modifications thereto will become more readily appreciated as the same becomes better understood by reference to the following detailed description, when taken in conjunction with the accompanying drawings, wherein.

Figure 5:
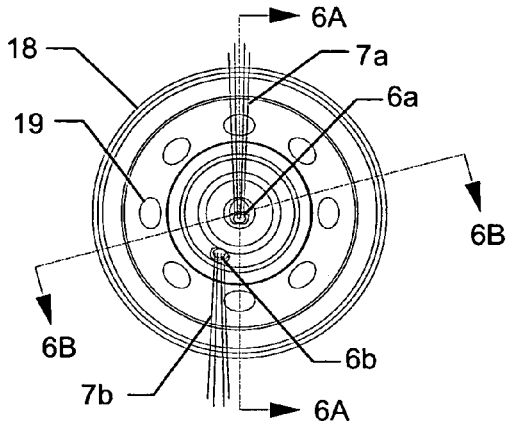
FIG. 5 is a distal end view of a second preferred embodiment of a rotary jetting tool including a pressure balanced rotor and an integral centrifugal brake.
Figure 6A:
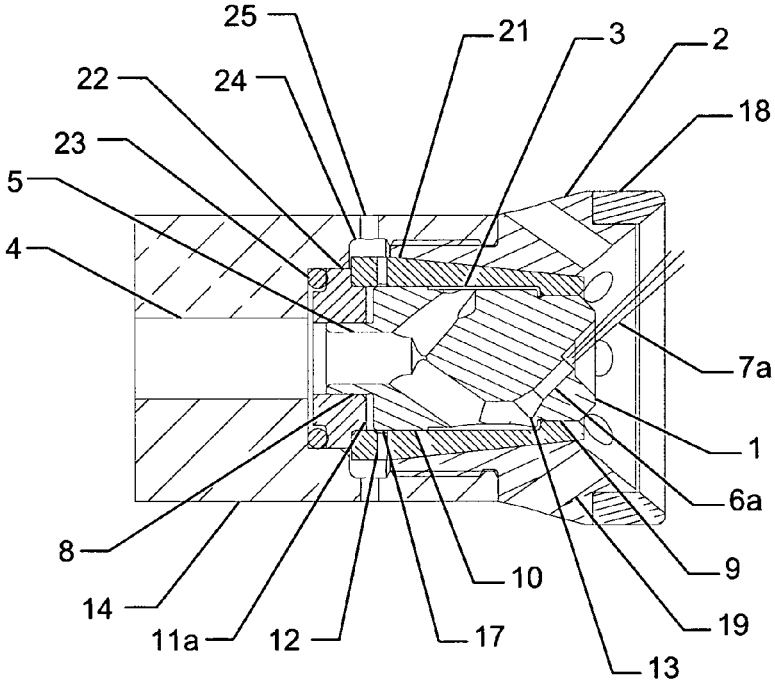
Figure 6B:
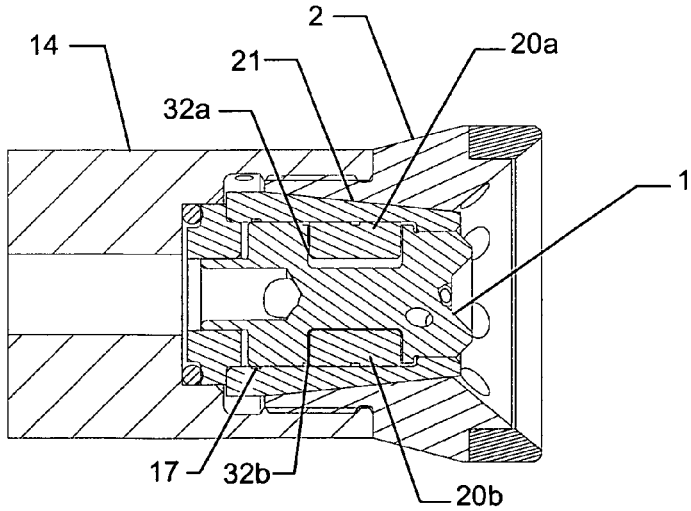

FIG. 6A is a cross-sectional side view of the rotary jetting tool of FIG. 5 taken along section line 6A—6A of FIG. 5, showing details relating to the flow of pressurized fluid through the jetting tool, a tapered housing, and a tapered cartridge; and FIG. 6B is a cross-sectional side view of the rotary jetting tool of FIG. 5 taken along section line 6B—6B of FIG. 5, showing details relating to the integral centrifugal brake, the tapered housing and the tapered cartridge.

DESCRIPTION

Figures and Disclosed Embodiments Are Not Limiting

Exemplary embodiments are illustrated in referenced Figures of the drawings. It is intended that the embodiments and Figures disclosed herein are to be considered illustrative rather than restrictive.

Figure 1:
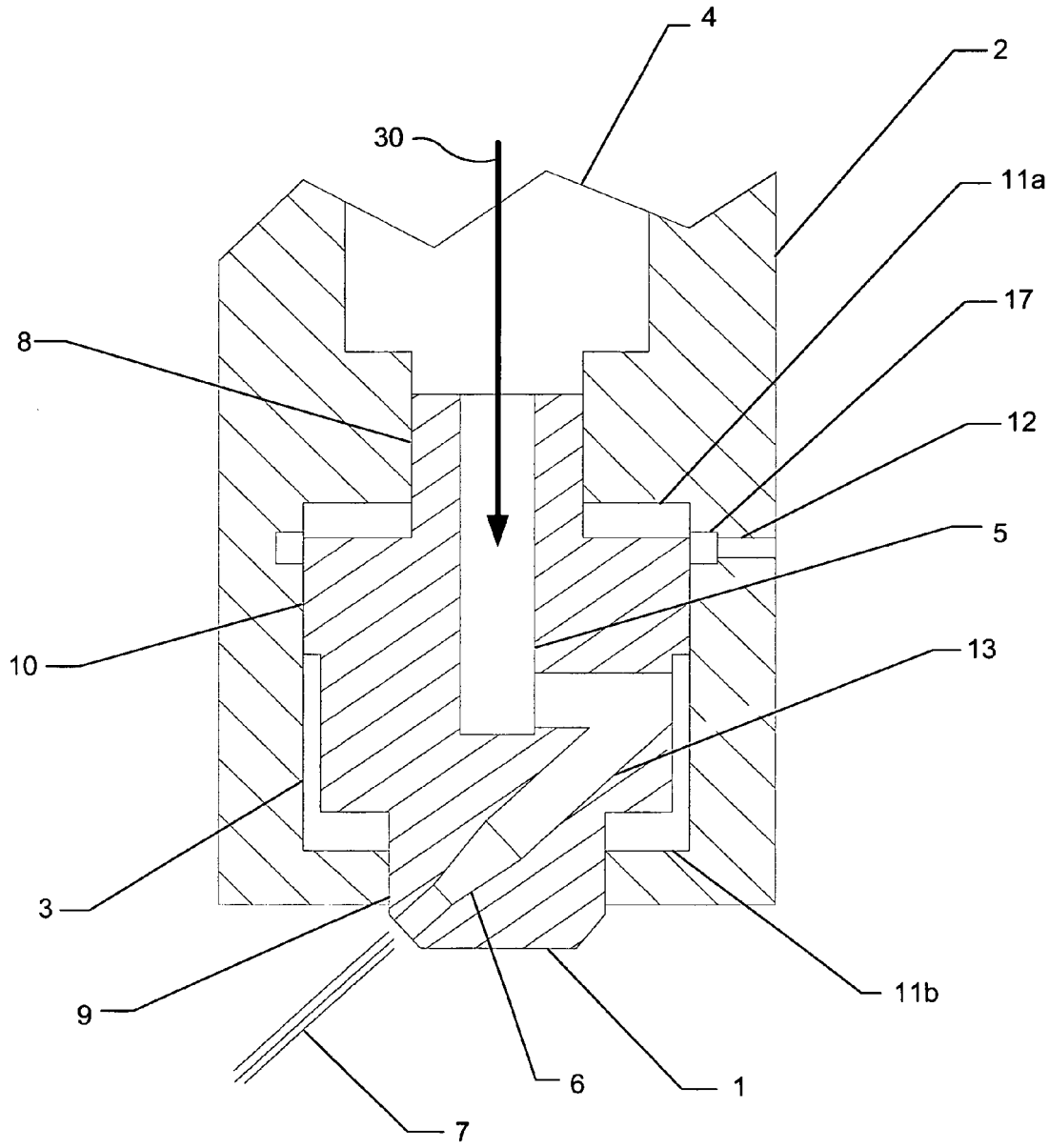
FIG. 1 is a cross-sectional side view of a rotary jetting tool including a vented pressure balancing chamber configured to enable the rotor to achieve a pressure balance condition.

Referring to FIG. 1, a rotary jetting tool (or assembly) including a pressure balanced rotor is illustrated. The tool includes two major components, a rotor 1 and a housing 2. Rotor 1 is disposed in housing 2, and the housing includes a pressure chamber 3 (capable of withstanding the rated operating pressures of the system). Rotor 1 is configured to rotate independently of housing 2. Furthermore, as discussed in greater detail below, rotor 1 can move axially relative to housing 2. A pressurized fluid enters at a proximal end of housing 2 through an inlet 4, and is conveyed through one or more passages 5 formed into rotor 1. This axial flow configuration allows the use of short, relatively large diameter passages in the rotor (i.e., passages 5), which pose a negligible flow restriction. Many prior art rotary jetting tools employ small fluid passages, leading to significant flow restrictions that substantially reduce the hydraulic efficiency of the tools.

The fluid is accelerated through one or more nozzles 6, and discharged from a distal end of the rotor as a fluid jet 7. FIG. 1 clearly illustrates a convergent nozzle, which can be beneficially employed for incompressible fluids such as water. However, a convergent-divergent nozzle can also be beneficially employed for compressible fluids such as supercritical carbon dioxide, nitrogen, or mixtures of gas and water. Nozzles 6 are positioned and oriented such that the reactive force of the jets discharged by the nozzles produce a torque about the center of rotation of the rotor, thereby imparting a rotational force to the rotor. Generally, the rotary jetting tool will be disposed at a distal end of a drill string or a coiled tube assembly. Significantly, the axial flow design of the rotary jetting tool enables a compact jetting tool to be achieved, making such a rotary jetting tool particularly well suited for drilling short radius holes. It should be recognized however, that such use is intended to be exemplary, rather than limiting on the scope of the present technology.

There are three radial clearance seal surfaces in the rotary jetting tool, including an entrance seal 8, an exit seal 9, and a body seal 10. Sealing is accomplished using a small clearance between the rotor shaft and the bore of the housing, such that a volume of fluid passing through the clearance is small compared with a volume of fluid being discharged by the nozzles.

In at least one exemplary embodiment, ultra-hard materials such as cemented carbide are used for each sealing surface. Such materials generally have relatively low coefficients of friction and provide superior wear resistance. Other forms of ultra-hard materials may alternatively be employed, such as polycrystalline diamond, flame-sprayed carbide, silicon carbide, cubic boron nitride, and amorphous diamond-like coating (ADLC). Preferably, for each pair of opposed sealing surfaces, each sealing surface is implemented using a different ultra-hard material, which those skilled in the art will recognize provide reduced friction. It should be recognized however, that the use of such ultra-hard materials is intended to be exemplary, rather than limiting on the scope of the technology as described herein.

It should be recognized that because the torque produced by fluid jets is relatively low, rotary jetting tools generally require some structure to minimize the torque that is required to rotate the rotor. In the context of the rotary jetting tools disclosed herein, the fluid introduced into the radial clearance seals acts as a hydrodynamic bearing, significantly reducing frictional forces acting on the rotor in the rotary jetting tool. As described in greater detail below, fluid leaking past the radial clearance seals described above will also leak into a proximal volume 11*a* and a distal volume 11*b*. Proximal volume 11*a* is particularly configured to enable rotor 1 to achieve a pressure balanced condition during operation of the rotary jetting tool, as described in greater detail below.

The projected area of entrance seal 8 multiplied by the system pressure generates a "downward" force on the rotor. The annular area between body seal 10 and inlet seal 8 forms proximal volume 11*a*, which acts as a pressure balancing chamber. The projected area of the pressure balancing chamber multiplied by the pressure in the pressure balancing chamber generates a "downward" force on the rotor. (Again, the terms "downward" and "upward" as used herein and throughout this disclosure are in reference to the directions shown in the Figures and are not to be construed as absolute directions or as limiting on the concepts disclosed; further, it should be recognized that the term "downward" refers to a direction consistent with a movement from inlet 4 towards nozzle 6, and the term "upward" refers to a direction consistent with a movement from nozzle 6 towards inlet 4). The annular area of pressure chamber 3 between body seal 10 and exit seal 9 multiplied by the system pressure produces an "upward" force acting on the rotor. Ambient pressure acting on the projected area of exit seal 9 multiplied by its area generates an "upward" force acting on the rotor. Significantly, the diameters of entrance seal 8, exit seal 9, and body seal 10 are selected to balance the upward and downward pressure forces on the rotor. An annular balance groove 17 with a bleed passage 12 is located in pressure chamber 3, and can be selectively placed in fluid communication with the pressure balancing chamber, such that the fluid in the pressure balancing chamber (proximal volume 11*a*) cannot escape through bleed passage 12 when the rotor is at its uppermost travel, and such that fluid can escape from the pressure balancing chamber (proximal volume 11*a*) as the rotor moves downwardly. During operation, fluid passes through entrance seal 8 into the pressure balancing chamber (proximal volume 11*a*), causing the pressure in the pressure balancing chamber to increase until the rotor is forced downwardly, thereby increasing a size of the pressure balancing chamber (proximal volume 11*a*). This axial movement of the rotor in the downward direction will result in annular balance groove 17 being uncovered or opened, such that bleed passage 12 is placed in fluid communication with the pressure balancing chamber (proximal volume 11*a*), which acts to reduce the pressure in the pressure balancing chamber. The rotor will achieve a position in which the pressure forces on it are in balance and the rotor moves neither up nor down, thereby achieving a pressure balanced condition.

One advantage of the design described above is that during fabrication of the rotary jetting tool, there is access to a nozzle settling chamber 13 from the side opposite the outlet of the nozzle. This access enables creation of a relatively large settling chamber and favorable inlet geometry for the nozzle.

An arrow 30 in FIG. 1 is intended to represent an axial flow. One significant aspect of the rotary jetting tool illustrated in FIG. 1 (and described above) is that the flow of the pressurized fluid introduced into the rotor is introduced in an axial fashion. Note that passage 5 of rotor 1 represents an axial volume that is coupled in fluid communication with inlet 4, such that the fluid entering inlet 4 and passage 5 maintains a substantially axial flow. Many other jetting tools incorporate structures (such as seals or plugs) disposed between the housing inlet configured to receive a pressurized fluid and internal volumes within the rotor, which require the use of diversion passages to introduce a pressurized fluid into the internal volumes within the rotor. These diversion passages interrupt the axial flow illustrated in FIG. 1. An axial flow configuration provides numerous benefits. The primary benefit is that the inlet flow restriction is minimized by providing a short, relatively open, axial flow passage. Rotary jetting tools configured to achieve an axial flow can be made substantially more compact (i.e., such rotary jetting tools generally exhibit a substantially more compact form factor than do conventional rotary jetting tools that include the above described diversion passages). Furthermore, the axial flow configuration described herein enables a rotary jetting tool to incorporate a fluid settling chamber (i.e., settling chamber 13) that is relatively large compared with the sealing diameter of the rotor (i.e., radial clearance seals 8, 9, and 10). In contrast, rotary jetting tools incorporating the fluid diversion structures noted above generally incorporate a settling chamber that is relatively small compared with the sealing diameter of the rotor. As noted above, larger settling chambers enhance the quality of the jet discharged from the rotary jetting tool.

Yet another benefit provided by the axial flow configuration discussed above is that the proximal end of the rotor can be readily accessed to afford coupling for power takeoff (i.e., mechanisms requiring rotation can be coupled to the proximal end of the rotor). This (rotational) power can be used for a number of purposes, such as mechanical work or electrical power generation, and can also be coupled to a braking mechanism mounted externally of the pressure chamber of the rotary jetting tool.

Figure 2:
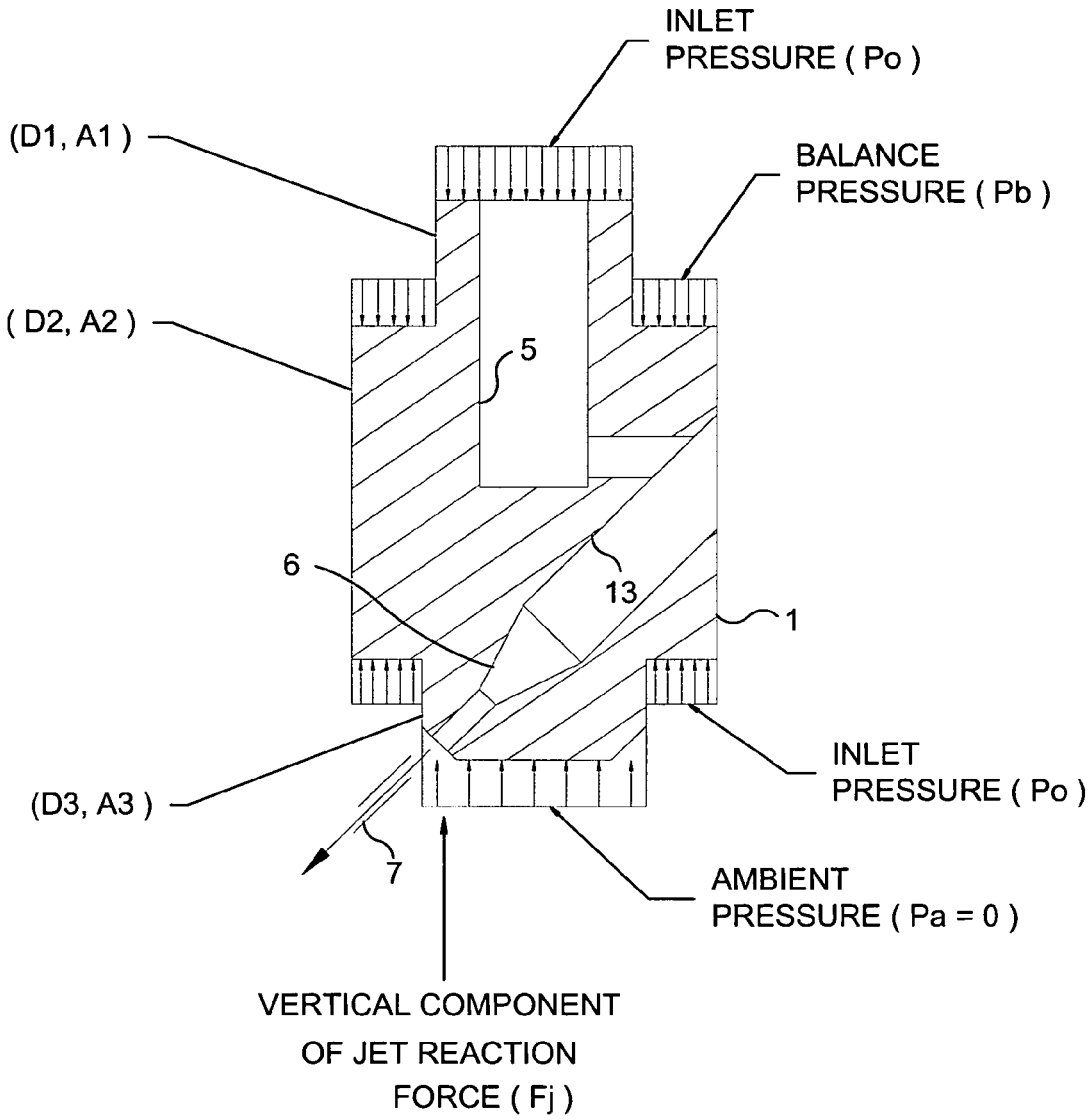
FIG. 2 is a free body diagram of the rotor, schematically depicting the forces acting on the rotor in the vertical direction (where "vertical" as used herein and throughout this disclosure is in reference to the direction shown in this Figure and is not to be construed as an absolute direction or limiting to the scope of the attendant concepts)

As discussed above, the rotor is acted upon by a number of hydraulic forces. FIG. 2 schematically illustrates these hydraulic forces, which will be relatively large as compared to other forces such as gravity or acceleration, so that these other forces can readily be neglected in the following analysis. Summing the forces in the vertical direction yields the following relationship:

$$Pa*A3+Po*(A2-A3)+Fj-Pb*(A2-A1)-Po*A1=0 \quad (1)$$

where:

- Fj is the vertical component of the jet reaction force
- Po is the inlet pressure to the rotor assembly
- Pa is the ambient pressure surrounding the rotor assembly
- Pb is the pressure in the pressure balancing chamber (i.e., proximal volume 11*a*)
- D1 and A1 are the effective sealing diameter and area of entrance seal 8
- D2 and A2 are the effective sealing diameter and area of body seal 10
- D3 and A3 are the effective sealing diameter and area of exit seal 9

The areas and diameters in this analysis are simply representations of the effective sealing diameters and areas of the seals. Assuming all pressures are taken relative to Pa, and setting, the force balance equation reduces to:

$$P_b = \frac{[P_0 * (A2 - A1 - A3) + F_j]}{(A2 - A1)} \quad (2)$$

The reaction force for a fluid jet is proportional to the pressure drop across the nozzle (Po) and the nozzle area (Aj). Accordingly, this relationship can be expressed as follows:

$$Fj=K*Po*Aj \quad (3)$$

where K is a constant. Substituting Equation 3 into Equation 2 yields the following:

$$P_b = \frac{[P_0 * (A2 - A1 - A3 + K * A_j)]}{(A2 - A1)} \quad (4)$$

which defines the pressure balanced condition. Examination of this equation reveals several insights. First, for a given geometry, the pressure in the pressure balancing chamber (proximal volume 11*a*) is proportional to the inlet pressure. Increasing the jet size, or the jet area, proportionally increases the pressure in the pressure balancing chamber. Noting that A2−A1 is the projected area of the pressure balancing chamber (proximal volume 11*a*), the pressure in the pressure balancing chamber will always be positive if A2−A1 is greater than A3, including when the jet reaction force is zero. This consideration is important when designing the inlet, body, and exit seal diameters, because positive pressure in the pressure balancing chamber is required to achieve the desired flotation or pressure balancing of the rotor. The above relationships can be used to facilitate selection of appropriate dimensions for the radial clearance seals discussed above. In practice, D2 is defined by the pressure housing dimensions; D3 is selected to be as large as possible consistent with sizing D1 such that a flow restriction induced by passages 5 generates a pressure differential that is small relative to the operating pressure (i.e., less than about 10%, and more preferably about 1% or less). Significantly, a cumulative area of each passage 5 is relatively large as compared to a cumulative area of each nozzle 6. Preferably, a flow area ratio of passages 5 and nozzles 6 will be about 10:1. That is, preferably the cumulative area of passages 5 will be about ten times the cumulative area of nozzles 6. Thus, if two nozzles are implemented, each having the same flow area, (i.e., each having the same cross sectional area at their minimum diameter, generally the outlet), and one flow passage coupling the rotor inlet to the two nozzles is employed, then the flow area of the one flow passage (i.e., the cross sectional area at a minimum diameter of the flow passage) will be relatively large compared to the cumulative flow area of the two nozzles. In a particularly preferred embodiment, the cumulative flow area of all flow passages (those passages coupling the rotor inlet to the nozzles) is about 10 times the cumulative flow area of the nozzles. However, that figure is intended to be exemplary, as beneficial tools can be implemented where the cumulative flow area of such passages is larger than the cumulative flow area of the nozzles, but not 10 times larger.

Another concept disclosed herein is a rotary jetting tool in which a brake mechanism is incorporated within an area of the rotor body. If the rotor shaft of a rotary jetting tool were allowed to spin unrestrained at full pressure, the rotation speed could be very high, causing excessive wear of the sealing components. Rotary jetting tools used in drilling applications often have a braking module coupled proximally of the rotary jetting tool, in between the drill string and at the rotary jetting tool. While such braking modules are effective, they substantially increase a length of the equipment disposed at a distal end of the drill string (i.e., the combination of a braking module and a rotary jetting tool is significantly longer than a rotary jetting tool alone). Disclosed herein is a rotary jetting tool which includes an integral brake (i.e., a braking mechanism disposed in between a distal end and a proximal end of the rotor in the rotary jetting tool), which enables a more compact rotary jetting tool with a braking capability to be achieved. When the integral brake is incorporated into a rotary jetting tool comprising the axial flow discussed above with respect to FIG. 1, a compact and self-braking rotary jetting tool can be achieved. While in a particularly preferred exemplary embodiment, the integral brake and pressure balanced rotor are implemented in a single rotary jetting tool, it should be recognized that either concept (i.e., a pressure balanced rotor, or a rotor with an integral brake) can be individually implemented in a rotary jetting tool, by applying the approach described herein. Thus, a rotary jetting tool incorporating both concepts is intended to be exemplary, rather than limiting in regard to the present disclosure.

Preferably the integrated braking mechanism includes centrifugally actuated mechanical friction brakes. It should be understood however, that a number of alternative braking mechanisms could instead be used. Some possible alternatives include, but are not limited to, braking mechanisms based on magnetic properties, viscous fluids, and fluid kinetics.

Figure 3:
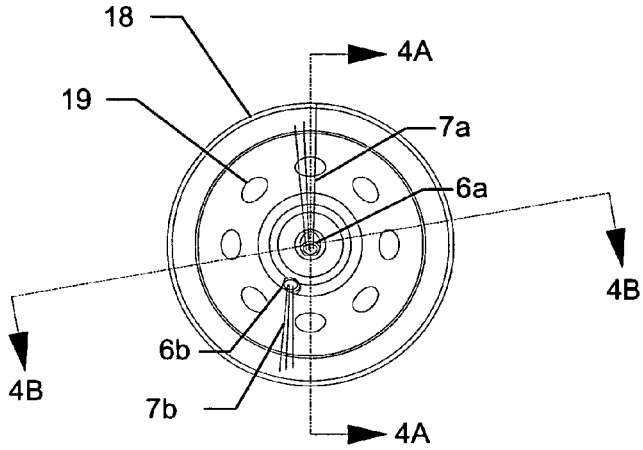
FIG. 3 is a distal end view of a first preferred embodiment of a rotary jetting tool including a pressure balanced rotor and an integral centrifugal brake.
Figure 4A:
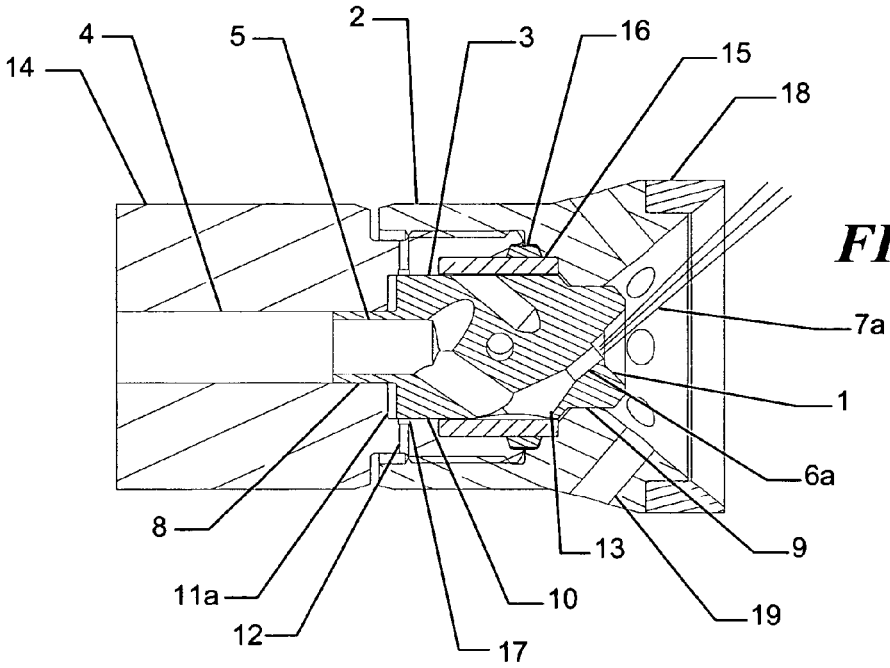
FIG. 4A is a cross-sectional side view of the rotary jetting tool of FIG. 3 taken along section line 4A—4A of FIG. 3, showing details relating to the flow of pressurized fluid through the jetting tool.
Figure 4B:
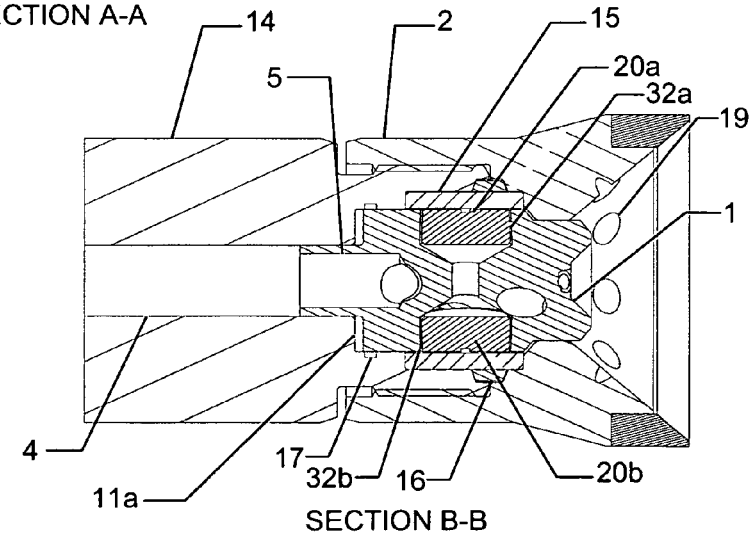
FIG. 4B is a cross-sectional side view of the rotary jetting tool of FIG. 3 taken along section line 4B—4B of FIG. 3, showing details relating to the integral centrifugal brake.

A first embodiment of a rotary jetting tool including a braking mechanism integral to the rotor is illustrated in FIGS. 3, 4A, and 4B. The braking mechanism itself is most visible in FIG. 4B. The rotary jetting tool of FIGS. 3, 4A, and 4B beneficially incorporates the pressure balanced rotor discussed above; however, those of ordinary skill in the art will recognize that the integral braking mechanism can be implemented in rotary jetting tools that do not incorporate the pressure balanced rotor described above. Spaces between jet nozzles in the rotor can be used to mount a braking mechanism. In one preferred exemplary embodiment, brake shoes are placed in pockets such that centrifugal force causes them to drag on the inner surface of the pressure chamber (i.e., inner surface of the housing). Such a configuration is particularly useful when achieving a compact tool size is a primary consideration.

FIG. 3 is a distal end view of the first preferred embodiment of a rotary jetting tool including a pressure balanced rotor and an integral centrifugal brake. FIG. 4A is a cross-sectional side view of the rotary jetting tool of FIG. 3, taken along section line 4A—4A of FIG. 3, showing details relating to the flow of pressurized fluid through the jetting tool, while FIG. 4B is a cross-sectional side view of the rotary jetting tool of FIG. 3, taken along section line 4B—4B of FIG. 3, showing details relating to the integral centrifugal brake. Reference numbers for structural elements that are the same as in the Figures described above are unchanged in regard to the present exemplary embodiment.

Referring now to FIGS. 3, 4A and 4B, rotor 1 is disposed inside pressure chamber 3 (defined by housing 2), with a rear adaptor 14 that is threaded into housing 2. The diameters of entrance seal 8, exit seal 9 and body seal 10 are selected as discussed above, to ensure that as the rotor approaches a pressure balanced configuration, the axial position of the rotor begins to uncover (i.e., open) annular balance groove 17, placing proximal volume 11*a* (the pressure balancing chamber) in fluid communication with bleed passage 12. Under these conditions, any additional fluid introduced into the pressure balancing chamber will be vented to the ambient volume. Thus, when a proximal edge of rotor 1 moves downwardly past an upper lip of annular balance groove 17, the pressure balancing chamber (i.e., proximal volume 11*a*) is vented to external pressure, forcing the rotor to move upwardly. When the proximal edge of rotor 1 moves back past the upper edge of annular balance groove 17, pressure increases inside the pressure balancing chamber (i.e., proximal volume 11*a*), causing the rotor to move downwardly. The use of annular balance groove 17 in connection with bleed passage 12 enables more precise control over the axial position of rotor 1 to be achieved than would be possible if bleed passage 12 were implemented without the use of annular balance groove 17.

In this exemplary embodiment, rotor 1 includes two nozzles 6*a* and 6*b*, which respectively discharge jets 7*a* and 7*b*. Nozzle 6*a* is disposed so that the jet discharges across the center axis of the rotor, thus ensuring that material ahead of the rotor is cut by the jet. Nozzle 6*b* is disposed on the circumference of the exposed portion of rotor 1, and is angled so that its jet impinges directly ahead of an erosion resistant standoff ring 18. Openings 19 are incorporated into housing 2 to enable debris produced during cutting to escape. The axis of nozzle 6*b* is offset from the axis of rotor 1, so that the jet reaction force generates a rotary torque on the rotor, causing it to spin. Further, the exit angle and diameter of nozzles 6*b* and 6*a* are identical, so as to cancel any side loads on rotor 1. One skilled in the art will recognize that it is possible to balance the side loads from any number of jets by proper combination of jet orientation and diameter.

In the rotary jetting tool embodiment shown in FIG. 4B, the jet rotor incorporates pockets 32*a* and 32*b* for brakes 20*a* and 20*b*, to govern the rotational speed of the rotor. The brakes frictionally engage sleeves 15, which are fixed to housing 2 by seal 16. Individual sleeves can be employed, or a single annular sleeve can be implemented. Brakes 20*a*, 20*b*, and sleeves 15 are preferably made from a wear resistant material, such as ceramic or cemented carbide. The torque generated by offset jet 7*b* is constant, while the frictional braking force increases with rotary speed. The rotor therefore spins at a constant speed, which is substantially lower than the runaway speed.

A second exemplary embodiment of a rotary jetting tool including a braking mechanism integral to the rotor is illustrated in FIGS. 5, 6A and 6B. The braking elements integrated in the rotor are most visible in FIG. 6B, although a tapered cartridge element configured to frictionally engage the braking elements integral to the rotor can be visualized in both FIGS. 6A and 6B. The rotary jetting tool of FIGS. 5, 6A, and 6B beneficially incorporates the pressure-balanced rotor discussed above; however, those of ordinary skill in the art should recognize that the integral braking mechanism can be implemented in rotary jetting tools that do not incorporate the pressure balanced rotor described above. The primary difference between the second embodiment of a rotary jetting tool including a braking mechanism and the first embodiment discussed above is the incorporation of the tapered cartridge element, which is discussed in greater detail below. Once again, this second embodiment is particularly well suited to achieve a compact rotary jetting tool with braking capability.

FIG. 5 is a distal end view of the second preferred embodiment of a rotary jetting tool including a pressure balanced rotor and an integral centrifugal brake. FIG. 6A is a cross-sectional side view of the rotary jetting tool of FIG. 5, taken along section line 6A—6A of FIG. 5, showing details relating to the flow of pressurized fluid through the jetting tool, while FIG. 6B is a cross-sectional side view of the rotary jetting tool of FIG. 5, taken along section line 6B—6B of FIG. 5, showing details relating to the integral centrifugal brake. Reference numbers for structural elements in common with earlier described Figures are unchanged.

As with previously described embodiments, rotor 1 is contained within pressure chamber 3 by rear adaptor 14, which is threaded into housing 2. The diameters of radial clearance seals (entrance seal 8, exit seal 9, and body seal 10) are selected as discussed above, to achieve the pressure-balanced condition, where hydraulic forces acting on the rotor are balanced when the axial position of the rotor places annular balance groove 17 and bleed passage 12 in fluid communication with the pressure balance volume (i.e., proximal volume 11*a*). In this embodiment, rotor 1 has two nozzles 6*a* and 6*b*, which discharge jets 7*a* and 7*b*, respectively. Nozzle 6*a* is disposed so that the jet discharges across the center axis of the rotor, thus ensuring that material ahead of the rotor is cut by the jet. Nozzle 6*b* is disposed on the circumference of the exposed portion of rotor 1 and is angled so that jet 7*b* impinges directly ahead of erosion resistant standoff ring 18. Openings 19 are incorporated into housing 2 to allow debris produced during cutting to escape. The axis of nozzle 6*b* is offset from the axis of rotor 1 so that the jet reaction force generates a rotary torque on the rotor, causing it to spin. As discussed with respect to the embodiments above, the exit angle and diameter of nozzles 6*a* and 6*b* are identical, so as to cancel any side loads on the rotor 1. The jet rotor incorporates pockets 32*a* and 32*b* for centrifugal brakes 20*a* and 20*b*, to govern the rotational speed of the rotor.

In the second preferred exemplary embodiment of a rotary jetting tool with braking elements incorporated into the rotor (i.e., the embodiment of FIGS. 5, 6A, and 6B), the braking elements frictionally engage a tapered cartridge 21, which fits into a corresponding taper formed inside housing 2. Brakes 20*a* and 20*b* and tapered cartridge 21 are preferably made from a wear resistant material such as ceramic or cemented carbide. The torque generated by offset jet 7*b* is constant, while the frictional braking force increases with rotary speed. The rotor therefore spins at a constant speed, which is substantially lower than the runaway speed. Tapered cartridge 21 incorporates bleed passage 12, annular balance groove 17, exit seal 9, and body seal 10, generally as described above. Rear adaptor 14 incorporates a fluid gathering chamber 24 and vent holes 25 that allow fluid to be discharged to an ambient volume. A bushing 22, constructed of wear resistant material, is placed inside in a pocket in rear adaptor 14 with an O-ring seal 23, which prevents leakage around the bushing. Bushing 22 provides an outer surface of entrance seal 8. The bushing is free to move axially until it engages tapered cartridge 21.

The tapered cartridge design allows the use of wear resistant materials on the sliding surfaces for the brakes and seals. Wear resistant materials, such as cemented carbide, generally do not provide the tensile strength required to accommodate the high internal pressures required for jet drilling. Internal pressure acting on the rear surface of bushing 22 forces the bushing against tapered cartridge 21. The angle of the taper is relatively small, so the force exerted by the bushing results in a circumferential compressive stress acting on the tapered cartridge, and a tensile stress acting on housing 2, which is preferably constructed from high tensile strength material, such as steel. The circumferential compressive stress balances the tensile stresses generated by internal pressure in the tapered cartridge. The cartridge design also enables the surfaces of radial clearance seals 9 and 10 to be machined in one setup, to ensure that the surfaces are concentric.

Some advantages of the embodiments described above include enabling the following to be achieved:

- short and compact rotary jetting tools;
- rotary jetting tools having jets directed towards the gauge of the tool;
- rotary jetting tools incorporating tapered fluid jet inlets to provide better quality fluid jets;
- rotary jetting tools with minimal flow restrictions between a tool inlet and a fluid jet outlet; and
- rotary jetting tools exhibiting the characteristic of having a fluid inlet diameter that is a substantial percentage of the tool diameter.

Although the present invention has been described in connection with the preferred form of practicing it and modifications thereto, those of ordinary skill in the art will understand that many other modifications can be made to the present invention within the scope of the claims that follow. Accordingly, it is not intended that the scope of the invention in any way be limited by the above description, but instead be determined entirely by reference to the claims that follow.

The invention claimed is:

1. A rotary jetting apparatus comprising:

(a) a housing defining a fluid path for a pressurized fluid;

(b) a rotor, at least a portion of which is disposed coaxially within the housing, the rotor including a proximal end and a distal end, the rotor being configured to rotate relative to the housing and to move axially relative to the housing, the rotor comprising:

(i) a fluid inlet disposed at the proximal end of the rotor, the fluid inlet being configured to receive the pressurized fluid from the fluid path, such that a direction of the pressurized fluid as it enters the rotor is coaxial with the rotor; and (ii) at least one nozzle disposed adjacent to the distal end of the rotor, the at least one nozzle being coupled in fluid communication with the fluid inlet and being configured to discharge a jet of the pressurized fluid, thereby causing the rotor to rotate relative to said housing;

(c) a first pressure balance volume defined by the housing and the rotor, the first pressure balance volume being disposed adjacent to the proximal end of the rotor; and (d) a vent configured to selectively place the first pressure balance volume in fluid communication with an ambient volume, as a function of an axial position of the rotor relative to the housing.

2. The rotary jetting apparatus of claim 1, further comprising a second pressure balance volume defined by the housing and the rotor, the second pressure balance volume being disposed adjacent to the distal end of the rotor.

3. The rotary jetting apparatus of claim 2, wherein the rotor sealingly engages the housing at:

(a) a first location disposed proximal of the first pressure balance volume;

(b) a second location disposed distal of the first pressure balance volume and proximal of the second pressure balance volume; and (c) a third location disposed distal of the second pressure volume.

4. The rotary jetting apparatus of claim 3, wherein a seal area associated with the third location is less than a difference between a seal area associated with the first location and a seal area associated with the second location.

5. The rotary jetting apparatus of claim 3, wherein a diameter associated with each of the first, second, and third locations has been selected so that the rotor experiences a balanced pressure condition when an axial position of the rotor relative to the housing is such that the first pressure balance volume is placed in fluid communication with the vent.

6. The rotary jetting apparatus of claim 1, wherein the at least one nozzle comprises at least one of the following (a) and (b):

(a) one over center jet and a plurality of offset jets; and (b) at least one over center jet and at least one offset jet.

7. The rotary jetting apparatus of claim 1, wherein the vent comprises an annular groove and at least one opening in the housing coupling the annular groove in fluid communication with an ambient volume.

8. The rotary jetting apparatus of claim 1, wherein the rotor further comprises a centrifugal brake governor configured to exert a braking force on the rotor once the rotor has reached a predetermined rotational speed, the centrifugal brake governor being disposed between the distal end and the proximal end of the rotor.

9. The rotary jetting apparatus of claim 8, wherein a distal end of said housing is tapered, further comprising a tapered cartridge constructed of a wear resistant material, the tapered cartridge engaging the distal end of the housing that is tapered, and being configured to frictionally engage the centrifugal brake governor.

10. The rotary jetting apparatus of claim 1, wherein a cumulative area of each passage in the rotor coupling the inlet to the at least one nozzle is relatively large as compared to a cumulative area of each at least one nozzle.

11. The rotary jetting apparatus of claim 10, wherein the cumulative area of each passage in the rotor coupling the inlet to the at least one nozzle is at least about ten times the cumulative area of each at least one nozzle.

12. A method for pressure balancing a rotor in a rotary jetting tool, the method comprising the steps of:

(a) introducing a pressurized fluid into the rotor via an inlet disposed at a proximal portion of the rotor, such that a direction of the pressurized fluid as it enters the rotor is coaxial with the rotor;

(b) discharging a major portion of the pressurized fluid introduced into the rotor from a distal portion of the rotor, such that a rotational force is imparted upon the rotor, and such that an axial force is exerted on the rotor, in a direction generally opposite the direction of the pressurized fluid as it enters the rotor; and (c) directing a minor portion of the pressurized fluid along a different fluid path, thereby exerting an axial force on the rotor in a direction generally corresponding to the direction of the pressurized fluid as it enters the rotor, thus pressure balancing the rotor.

13. The method of claim 12, further comprising the step of placing the minor portion of the pressurized fluid exerting the axial force on the rotor in fluid communication with an ambient volume when a magnitude of the axial force exerted on the rotor by the minor portion of the pressurized fluid exceeds a magnitude of the axial force exerted on the rotor by the major portion of the pressurized fluid discharged from the distal end of the rotor.

14. The method of claim 12, further comprising the step of conveying the pressurized fluid from the inlet to at least one nozzle using at least one passage, such that a cumulative area of each such passage is relatively large as compared to a cumulative area of each at least one nozzle.

15. The method of claim 12, further comprising the step of controlling a maximum rotational speed of the rotor using a centrifugal brake incorporated into the rotor.

16. A method for pressure balancing a rotor in a rotary jetting tool, the method comprising the steps of:

(a) providing a pressure balancing volume defined by the rotor and a non-rotating portion of the rotary jetting tool;

(b) introducing a pressurized fluid into the rotor via an inlet disposed at a proximal portion of the rotor, such that a direction of the pressurized fluid as it enters the rotor is coaxial with the rotor;

(c) discharging the pressurized fluid from the rotor from a distal portion of the rotor, such that a rotational force is imparted upon the rotor, and such that the rotor moves axially, thereby reducing a size of the pressure balancing volume;

(d) directing a portion of the pressurized fluid into the pressure balancing volume, thereby establishing a hydrodynamic bearing between the rotor and the non-rotating portion of the rotary jetting tool; and (e) increasing the amount of pressurized fluid in the pressure balancing volume, such that the rotor moves axially, thereby increasing a size of the pressure balancing volume, until a vent placing the pressure balancing volume in fluid communication with an ambient volume is opened, thereby pressure balancing the rotor.

17. A rotary jetting apparatus comprising:

(a) a housing defining a fluid path for a pressurized fluid;

(b) a rotor, at least a portion of which is disposed coaxially within the housing, the rotor including a proximal end and a distal end, the rotor being configured to rotate relative to the housing and to move axially relative to the housing, the distal end comprising at least one nozzle in fluid communication with the fluid path, the at least one nozzle being configured to discharge a jet of the pressurized fluid, thereby causing the rotor to rotate relative to said housing;

(c) a first pressure balance volume defined by the housing and the rotor, the first pressure balance volume being disposed adjacent to the proximal end of the rotor;

(d) a second pressure balance volume defined by the housing and the rotor, the second pressure balance volume being disposed adjacent to the distal end of the rotor; and (e) a vent configured to selectively place the first pressure balance volume in fluid communication with an ambient volume, based upon an axial position of the rotor relative to the housing.

18. The rotary jetting apparatus of claim 17, wherein the rotor sealingly engages the housing at:

(a) a first location disposed proximal of the first pressure balance volume;

(b) a second location disposed distal of the first pressure balance volume and proximal of the second pressure balance volume; and (c) a third location disposed distal of the second pressure volume, wherein a diameter associated with each of the first, second, and third locations has been selected so that the rotor experiences a balanced pressure condition when an axial position of the rotor relative to the housing is such that the first pressure balance volume is placed in fluid communication with the vent.

19. The rotary jetting apparatus of claim 17, wherein the rotor further comprises a centrifugal brake governor configured to exert a braking force on the rotor once the rotor has reached a predetermined rotational speed, the centrifugal brake governor being disposed at a location between the distal end and the proximal end of the rotor.

20. The rotary jetting apparatus of claim 17, wherein the rotor further comprises a fluid inlet disposed at the proximal end of the rotor, the fluid inlet being configured to receive the pressurized fluid from the fluid path, such that the pressurized fluid enters the rotor in a direction that is parallel to a longitudinal axis of the rotor.

21. The rotary jetting apparatus of claim 17, wherein the vent comprises an annular groove and at least one opening in the housing coupling the annular groove in fluid communication with an ambient volume.

22. The rotary jetting apparatus of claim 17, wherein the at least one nozzle comprises at least one of the following (a) and (b):

(a) one over center jet and a plurality of offset jets; and (b) at least one over center jet and at least one offset jet.

23. A rotary jetting apparatus comprising:

(a) a housing defining a fluid path for a pressurized fluid;

(b) a rotor, at least a portion of which is disposed coaxially within the housing, the rotor including a proximal end and a distal end, the rotor being configured to rotate relative to the housing, the distal end comprising at least one nozzle in fluid communication with the fluid path, the at least one nozzle being configured to discharge a jet of the pressurized fluid, thereby causing the rotor to rotate relative to said housing; and (c) a centrifugal brake disposed between the proximal end and the distal end of the rotor, the centrifugal brake being configured to frictionally engage the rotor at a predetermined rotational speed, thereby limiting a maximum rotational speed of the rotor.

24. The rotary jetting apparatus of claim 23, wherein the rotor further comprises a fluid inlet disposed at the proximal end of the rotor, the fluid inlet being configured to receive the pressurized fluid from the fluid path, such that the pressurized fluid enters the rotor in an axial direction.

25. The rotary jetting apparatus of claim 23, wherein the rotor can move axially relative to the housing, further comprising:

(a) a first pressure balance volume defined by the housing and the rotor, the first pressure balance volume being disposed adjacent to the proximal end of the rotor; and (b) a vent configured to selectively place the first pressure balance volume in fluid communication with an ambient volume, as a function of an axial position of the rotor relative to the housing.

26. The rotary jetting apparatus of claim 25, wherein the vent comprises an annular groove and at least one opening in the housing coupling the annular groove in fluid communication with an ambient volume.

27. The rotary jetting apparatus of claim 25, wherein the rotor sealingly engages the housing at a first location disposed proximal of the first pressure balance volume, a second location disposed distal of the first pressure balance volume and proximal of a distal end of the rotor, and at a third location at the distal end of the rotor, wherein a diameter associated with each of the first, second, and third locations is selected so that the rotor experiences a balanced pressure condition when an axial position of the rotor relative to the housing is such that the first pressure balance volume is placed in fluid communication with the vent.

28. The rotary jetting apparatus of claim 23, wherein a distal end of said housing is tapered, and further comprising a tapered cartridge constructed of a wear resistant material, the tapered cartridge engaging the distal end of the housing that is tapered, and being configured to frictionally engage the centrifugal brake.

29. The rotary jetting apparatus of claim 23, wherein the at least one nozzle comprises at least one of the following (a) and (b):

(a) one over center jet and a plurality of offset jets; and (b) at least one over center jet and at least one offset jet.

* * * * *